US006776509B1

(12) United States Patent
Warner

(10) Patent No.: US 6,776,509 B1
(45) Date of Patent: Aug. 17, 2004

(54) LIGHTING FEATURE INCLUDING REMOVABLE ELLIPSOIDAL SHAPED REFLECTORS

(75) Inventor: Chris Warner, Hamilton, AL (US)

(73) Assignee: Genlyte Thomas Group LLC, Louisville, KY (US)

( * ) Notice: Subject to any disclaimer, the term of this patent is extended or adjusted under 35 U.S.C. 154(b) by 113 days.

(21) Appl. No.: 09/949,054

(22) Filed: Sep. 7, 2001

(51) Int. Cl.[7] ..... F21V 7/08

(52) U.S. Cl. ..... 362/296; 362/297; 362/217; 362/225; 362/364

(58) Field of Search ..... 362/296, 297, 362/217, 225, 364, 346

(56) References Cited

U.S. PATENT DOCUMENTS 5,921,666 A * 7/1999 Preston et al. ..... 362/341

6,053,624 A * 4/2000 Cronk ..... 362/347

* cited by examiner

*Primary Examiner*—Stephen Husar
*Assistant Examiner*—Anabel Ton
(74) *Attorney, Agent, or Firm*—Charles G. Lamb; Steven A. Witters; Middleton Reutlinger

(57) ABSTRACT

A light fixture having a relatively narrow light emitting aperture in a bottom thereof, includes a pair of elliptically shaped reflectors mounted therein, wherein first terminating ends of each reflector are connected, the elliptically shaped reflectors extending in parallel along the housing. Disposed inwardly from each reflector and spaced therefrom are light sources, each said light source extending in parallel relation. The ellipsoidal reflectors being positioned to reflect light through the narrow width aperture.

19 Claims, 2 Drawing Sheets

LIGHTING FEATURE INCLUDING REMOVABLE ELLIPSOIDAL SHAPED REFLECTORS

BACKGROUND OF THE INVENTION

The present invention relates to a lighting system, including removable ellipsoidal configured reflectors. More particularly, the present invention relates to a lighting system having a lighting housing with a narrow width light emitting slot with a two piece ellipsoidal reflector removable through said narrow width slot.

Lighting systems, and particularly fluorescent lighting systems, are well known for use as ceiling lights. More particularly, it is well known to recess the fluorescent lighting housings above the ceiling so that the bottom panels of the housing are in alignment with the ceiling, thereby providing a ceiling with a clean appearance. Moreover, in many housings, even though the bottom of the housing may be flush with the ceiling, large openings for the emission of light have been necessary to provide adequate lighting for a room. Thus, there has been a desire to improve the clean appearance of the ceiling by narrowing the width of the light emitting slot from the housing. U.S. Pat. No. 5,921,666 to Preston et al teaches a recessed light fixture which includes a housing having a front or bottom panel with a narrow aperture therein for passing light therethrough. This reference teaches an elongated reflector of ellipsoidal configuration disposed behind the light source and inside the housing to reflect the light generated by the light source through the aperture. However, in fluorescent lighting fixtures, the ballast and other electrical components for operating the fluorescent lamps are generally disposed above the top plate of the housing and are accessible only from above the housing by removing a top plate or cover. Thus, for a recessed lighting fixture having a relatively narrow light-emitting slot, the electrical components can only be accessed from above the ceiling.

SUMMARY OF THE INVENTION

It is an object of the present invention to provide an improved recessed light fixture of the type having a narrow width light emitting slot with access to electrical components mounted along the top of the lighting fixture from below the fixture.

It is another object of the present invention to provide a two-piece reflector device wherein each reflector is of ellipsoidal configuration and capable of being inserted into a light fixture housing through a narrow width slot in the bottom of the housing.

It is also an object of the present invention to provide a pair of ellipsoidal shaped reflectors having mating terminating ends.

It is even a further object of the present invention to provide a method for installing a pair of ellipsoidal shaped reflectors having mating connectable terminating ends in a lighting fixture having a narrow width light emitting slot More particularly, the present invention provides a light fixture, including a housing with two spaced side panels, each side panel extending downwardly and inwardly with lower terminating edges defining a narrow width light emitting slot therebetween. A pair of ellipsoidal elongated reflectors wherein each reflector has an inside surface, including a plurality of segments of ellipsoidal cross section disposed between a light source and an inner surface of the housing. The ellipsoidal shaped elongated reflectors are provided with mating terminating ends wherein the light is reflected from the reflectors to a focal point which is disposed within the light emitting slot.

Additional objects, features and advantages of the invention will become apparent to those skilled in the art, upon consideration of the following detailed description of the preferred embodiment exemplifying the best mode of carrying out the invention as presently perceived. The detailed description particularly refers to the accompanying figures in which:

It should be understood that the drawings are not necessarily to scale and that the preferred embodiment is illustrated by sectional views, which illustrate the typically used steps in installing the reflectors in a light fixture housing. Moreover, in the instances where details are not necessary for an understanding of the present invention, or which render other details difficult to perceive, such details may have been omitted. Even further, it should be understood that the invention is not necessarily limited to the particular embodiment illustrated and described herein.

DETAILED DESCRIPTION OF THE PREFERRED EMBODIMENT

Figure 1:
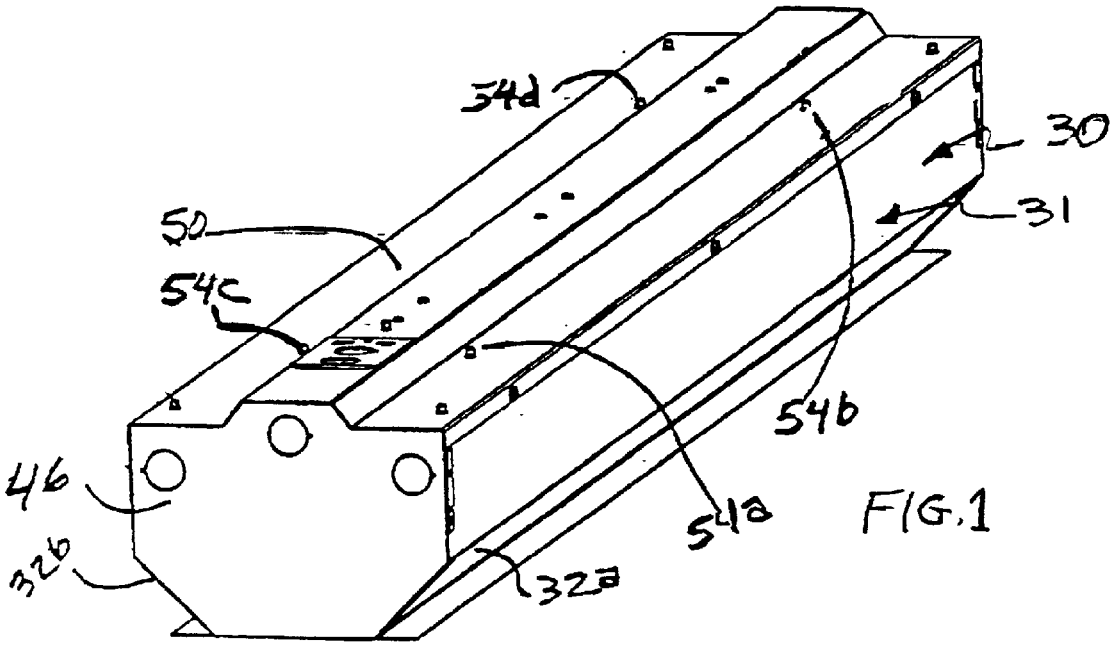
FIG. 1 is a perspective view of a lighting fixture of the present invention.

As best shown in FIG. 1, a light fixture 30, which may be recessing in a ceiling (not shown), includes a housing 31 having a top plate 50 with opposed side panels 32*a* and 32*b*, and an end panel 46. The side panels 32*a* and 32*b* extend downwardly and then inwardly to lower terminating edges 37*a* and 37*b*, respectively.

Figure 2:
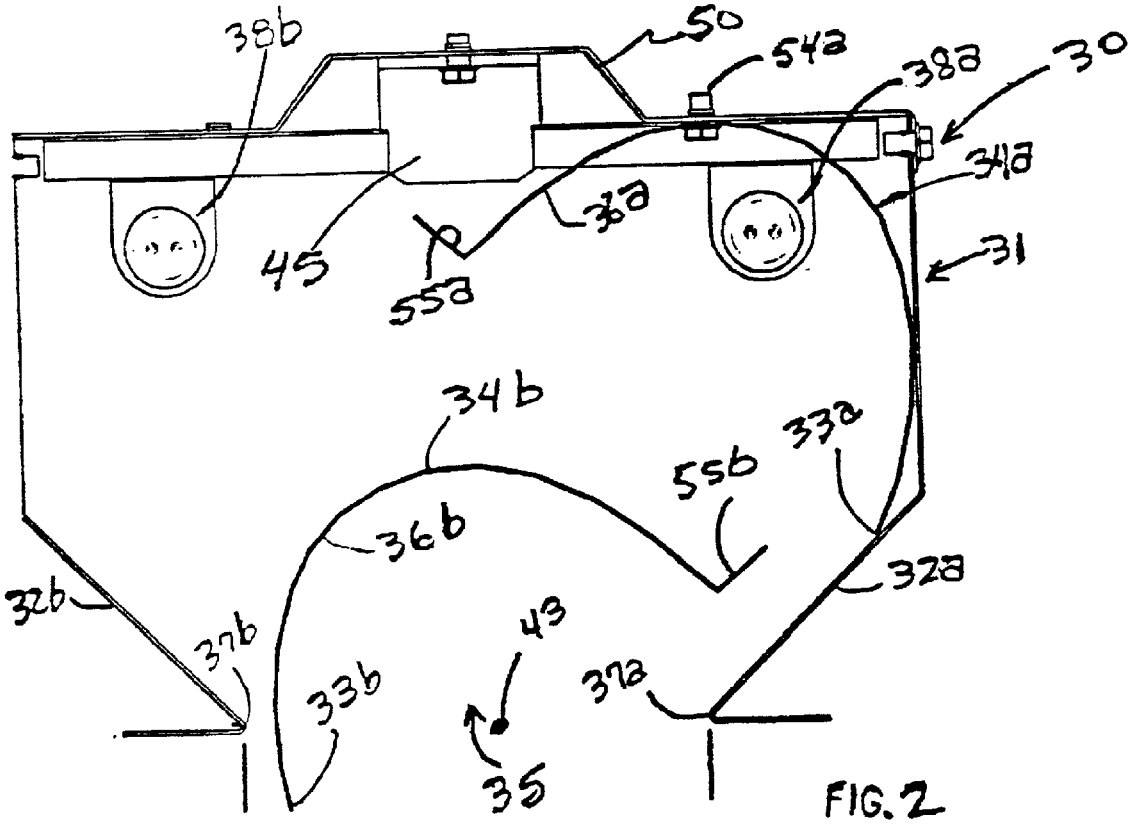
FIG. 2 is a sectional view of a light fixture of FIG. 1 showing two elliptically figured reflectors of the present invention with one reflector being in an installed position and a second reflector being inserted through a bottom narrow slotted opening of a light fixture housing.
Figure 3:
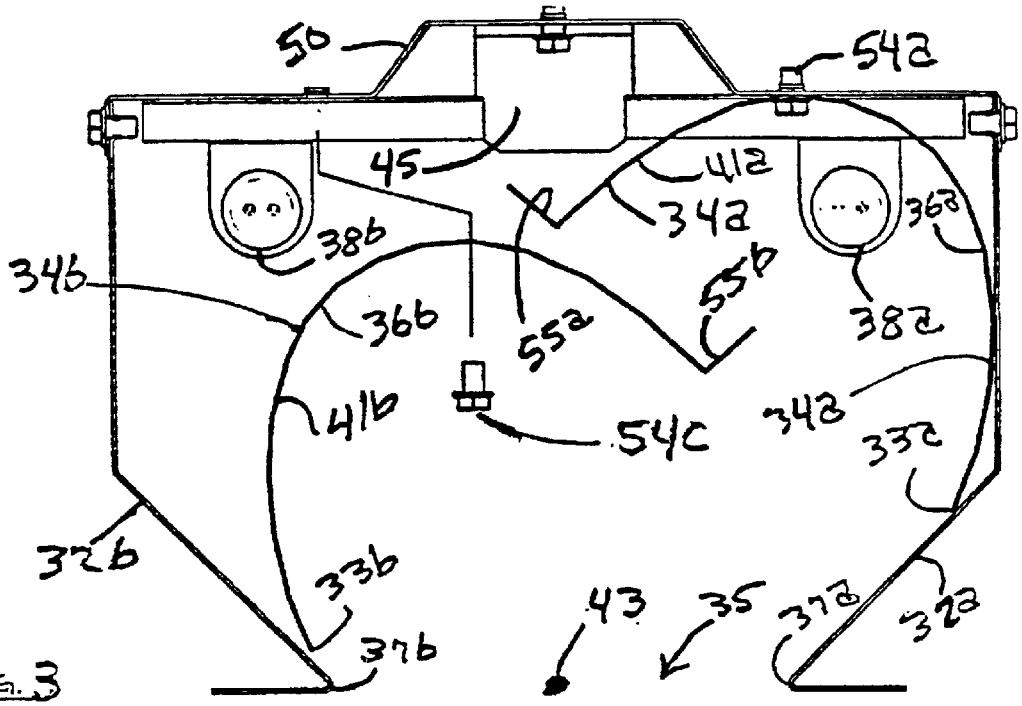
FIG. 3 is a sectional view of FIG. 1 showing the second reflector disposed within the light fixture housing but not installed in place; and, FIG. 4 is a sectional view of the light fixture of FIG. 1 showing both reflectors in an installed condition.
Figure 4:
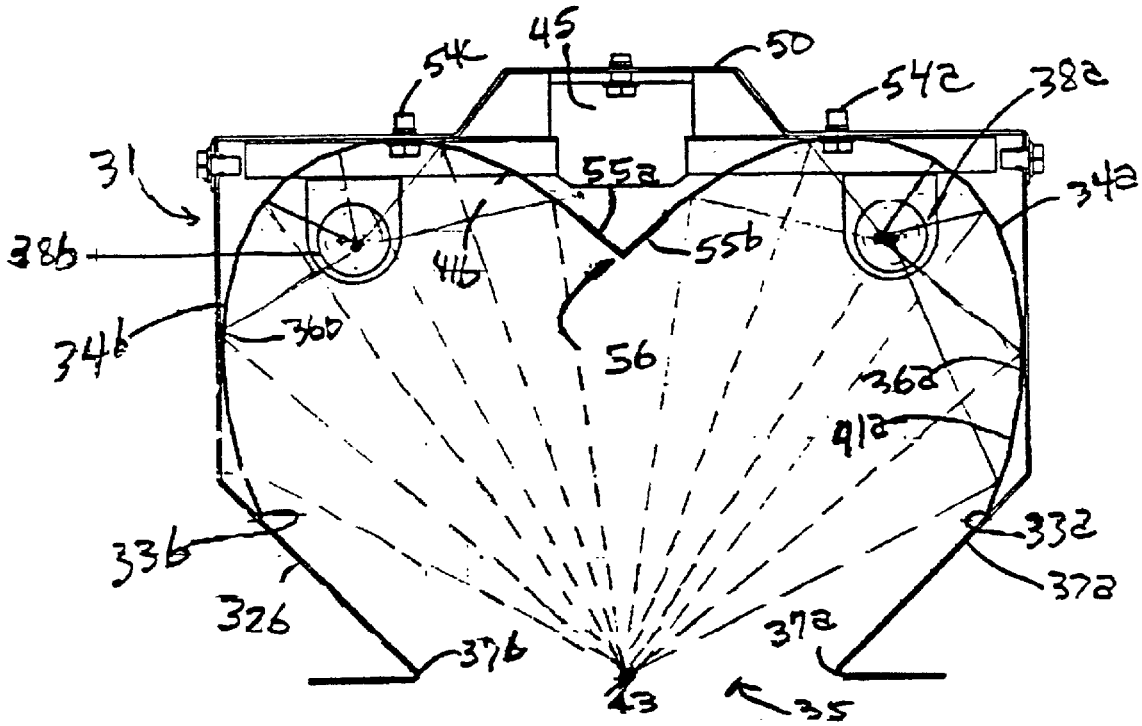

As shown in FIGS. 2–4, the terminating edges 37*a* and 37*b* of the side panels 32*a* and 32*b*, respectively, define a relatively narrow light emitting opening or aperture 35. Two ellipsoidal configured reflectors 34*a* and 34*b* are received within the housing 31.

As best shown in FIG. 4, the reflectors 34*a* and 34*b* are mounted to the top plate 50 of the housing 31 with reflector mounting screws 54*a*, 54*b*, 54*c* and 54*d*. Each reflector 34*a* and 34*b* has opposed terminating ends, reflector 34*a* including a lower outer edge 33*a* at one end and a V-shaped connecting or nesting end 55*a* at an opposed end whereas reflector 34*b* has a lower terminating outer edge 34*b* at one end and an opposed V-shaped connecting or nesting end 55*b* at an opposed end, end 55*b* being received by and nesting within the V-shaped nesting end 55*a* of reflector 34*a*. The housing inner edges 37*a* and 37*b* extend inwardly past the lower terminating outer edges 33*a* and 33*b* of the reflectors 34*a* and 34*b*, respectively wherein the outer edges 33*a*, 33*b* engage inner sides of said panels 32*a*, 32*b*, at a position above edges 37*a*, 37*b*.

Each reflector 34*a* and 34*b* is made up of a plurality of ellipsoidal segments 36*a* and 36*b*, respectively, which circumscribe an individual light source for each reflector. Specifically, reflector 34*a* circumscribes the light source 38*a* and the reflector 34*b* circumscribes the light source 38*b*, the light sources being elongated fluorescent tubes.

Referring back to FIG. 4, substantially all of the light reflected off the inside surfaces 41*a* and 41*b* passes through a common focal point or area indicated at 43. However, it is realized that the reflectors 34*a* and 34*b* could be designed so that all light reflected off the inside surfaces 41*a* and 42*b*, respectively, pass through a narrowly defined point such as indicated at 43 or the reflectors 34*a* and 34*b* could be designed so that all light reflected off the surfaces 41*a* and 41*b*, respectively, pass through a broader space or area. And, the focal point or area indicated at 43 is referred to broadly as the focal area 43. Thus, because the reflected light passes through the focal area 43, aperture or opening 35 can be narrower than in prior art recessed light fixtures.

As shown in FIGS. 2–4, the light fixture 30 is provided with a ballast 45, which is attached to the top plate 50. And, as shown in FIG. 4, when the reflectors 34*a*, 34*b* are in a use condition the V-shaped nesting connections 55*a* and 55*b* are in a nesting relation and overlap as indicated at 56. With the reflectors 34*a*, 34*b* in a use condition, the ballast 45 and other electrical components and connections are not easily accessible. As shown in FIG. 2, with the reflector 34*b* being partially removed from the housing 31, the reflector 34*a* may also be removed from the housing thereby exposing the ballast 45 and other electrical components for easy access.

FIGS. 2–4 also illustrate one method for installing the reflectors 34*a* and 34*b* into a housing 31 having a relatively narrow slot 35 in the bottom of the housing. As shown in FIG. 2, the reflector 34*a* has been installed into the housing 31 and held in place with the reflector mounting screws 54*a* and 54*b* (FIG. 1) and the manner for installing the reflector 34*a* is essentially the same sequence as the following for installing the reflector 34*b*. That is, the reflector 34*b* is first fed through the narrow slot 35 using the V-shaped terminating end 55*b* being threaded through the slot 35 first (FIG. 2). The rest of the reflector 34*b* is then threaded through the slot 35 (FIG. 3) and positioned so that the V-shaped terminating end 55*b* receives the V-shaped nesting connecting terminating 55*a* of the reflector 34*a*.

As shown in FIG. 4, once the V-shaped end 55*a* is received within the V-shaped end 55*b*, reflecting mounting screws 54*c* and 54*d* (FIG. 1) are installed to hold the reflector 34*b* in place.

Although the invention has been described in detail with reference to a preferred embodiment, variations and modifications exist within the scope and spirit of the present invention as set forth in the following claims.

What is claimed is:

1. A light fixture comprising:

a housing including two spaced side panels, said side panels having downwardly extending walls and inwardly depending walls with lower terminating edges defining an aperture of a preselected width extending therebetween;

first and second preformed elliptically shaped elongated reflectors removably connected within said housing, said reflectors having first terminating ends removably connectable to each other and opposed second terminating ends facing inwardly and engaging inner sides of said side panels at a position above said terminating edges with said aperture disposed therebetween; and, each of said reflectors having an inside surface with an elongated light source positioned inwardly therefrom and extending in parallel to each said reflector, each said reflector reflecting light generated by its respective light source through said aperture.

2. The light fixture of claim 1, each of said reflectors having a side surface including at least two segments of ellipsoidal cross section, each segment reflecting light generated by the respective light source of said reflector through said aperture.

3. The recessed light fixture of claim 2, each of said ellipsoidal segments having an elongated common focal area, the focal area being located along a common plane of the terminating edges of said reflectors in said aperture.

4. The light fixture of claim 1, said light sources being spaced apart by a distance greater than said preselected width of said aperture.

5. The light fixture of claim 1, said light sources being fluorescent light sources.

6. The light fixture of claim 1, each of said first terminating ends of said first and said second elongated reflectors being of V-shaped configuration and connectable in a nesting relation to each other.

7. A light fixture comprising:

a housing including two spaced side panels, said side panels having downwardly extending walls and inwardly depending walls with lower terminating edges defining an aperture of a preselected width therebetween;

first and second preformed ellipsoidal shaped elongated reflectors disposed within said housing, said first and second elongated reflectors being aligned in parallel and having first terminating ends removably connectable to each other and opposed second terminating ends facing inwardly and engaging inner sides of said side panels at a position above said terminating edges; and, each said reflector baying an elongated light source positioned inwardly of an inside surface of said reflector and extending parallel thereto.

8. The light fixture of claim 7, said first terminating ends being of V-shaped configuration and disposed in nesting relationship with each other.

9. The light fixture of claim 7, each of said reflectors having a side surface including at least two segments of ellipsoidal cross section, each segment reflecting light generated by the respective light source of said reflector through said aperture.

10. The light fixture of claim 9, each of said ellipsoidal segments having an elongated common focal area, the focal area being located along a common plane of the terminating edges of said reflectors in said aperture.

11. The light fixture of claim 7, said light sources being spaced apart by a distance greater than said preselected width of said aperture.

12. The light fixture of claim 7, said light sources being fluorescent light sources.

13. A method for installing reflectors in a light fixture comprising:

threading a first terminating end of a first reflector through a slot in a housing including two spaced side panels, said side panels having downwardly extending walls and inwardly depending walls with lower terminating edges defining an aperture therebetween, said first reflector being of preformed elliptically shaped configuration;

removably attaching said first reflector to a top panel of said housing;

threading a first terminating end of a second reflector of preformed elliptically shaped configuration through said aperture;

removably attaching said second reflector to said top panel and said first terminating end of said second reflector to said first reflector first terminating end; and, engaging inner sides of said side panels with opposed second terminating ends of said reflectors at a position above said terminating edges.

14. The method of claim 13, each of said reflectors having a side surface including at least two segments of ellipsoidal cross section, each segment reflecting light generated by the respective light source of said reflector through said aperture.

15. The method of claim 14, each of aid ellipsoidal segments having an elongated common focal area, the focal area being located along a common plane of the terminating edges of said reflectors in said aperture.

16. The method of claim 13, said light sources being spaced apart by a distance greater than said preselected width of said aperture.

17. The method of claim 13, said light sources being fluorescent light sources.

18. The method of claim 13, each of said first and said second elongated reflectors having first terminating ends of V-shaped configuration and connectable in a nesting relation to each other.

19. the light fixture of claim 1 wherein said depending walls depend inward from downwardly extending walls at an angle greater than 90°.

* * * * *